US009139927B2

(12) United States Patent
Rash et al.

(10) Patent No.: US 9,139,927 B2
(45) **Date of Patent: *Sep. 22, 2015**

(54) ELECTROLYTE LOOP WITH PRESSURE REGULATION FOR SEPARATED ANODE CHAMBER OF ELECTROPLATING SYSTEM

(71) Applicant: Novellus Systems, Inc., Fremont, CA (US)

(72) Inventors: Robert Rash, Portland, OR (US); Richard Abraham, Sherwood, OR (US); David W. Porter, Sherwood, OR (US); Steven T. Mayer, Lake Oswego, OR (US)

(73) Assignee: Novellus Systems, Inc., Fremont, CA (US)

( * ) Notice: Subject to any disclaimer, the term of this patent is extended or adjusted under 35 U.S.C. 154(b) by 8 days.

This patent is subject to a terminal disclaimer.

(21) Appl. No.: 14/074,510

(22) Filed: Nov. 7, 2013

(65) Prior Publication Data

US 2014/0131211 A1 May 15, 2014

Related U.S. Application Data

(63) Continuation of application No. 13/051,822, filed on Mar. 18, 2011, now Pat. No. 8,603,305.

(60) Provisional application No. 61/315,679, filed on Mar. 19, 2010.

(51) Int. Cl.

| | |
|---|---|
| ***C25D 21/16*** | (2006.01) |
| ***C25D 21/10*** | (2006.01) |
| ***C25D 17/02*** | (2006.01) |
| ***C25D 5/08*** | (2006.01) |
| ***C25D 21/04*** | (2006.01) |

(Continued)

(52) U.S. Cl.
CPC *C25D 5/08* (2013.01); *C25D 5/006* (2013.01); *C25D 17/00* (2013.01); *C25D 17/002* (2013.01); *C25D 21/04* (2013.01); *C25D 21/06* (2013.01); *C25D 21/14* (2013.01); *C25D 21/18* (2013.01)

(58) Field of Classification Search
None
See application file for complete search history.

(56) References Cited

U.S. PATENT DOCUMENTS

| | | | |
|---|---|---|---|
| 3,664,440 | A | 5/1972 | Elenburg |
| 4,003,263 | A | 1/1977 | O'Rourke |

(Continued)

FOREIGN PATENT DOCUMENTS

| | | |
|---|---|---|
| EP | 0 048 579 | 12/1984 |
| JP | 04-024440 | 4/1992 |

(Continued)

OTHER PUBLICATIONS

U.S. Appl. No. 13/359,343, filed Jan. 26, 2012, entitled "Control of Electrolyte Composition in a Copper Electroplating Apparatus", Buckalew et al.

(Continued)

*Primary Examiner* — Harry D Wilkins, III
(74) *Attorney, Agent, or Firm* — Weaver Austin Villeneuve & Sampson LLP

(57) ABSTRACT

An electrolyte, and particularly anolyte, may be circulated via an open loop having a pressure regulator, so that the pressure in the plating chamber is maintained at a constant (or substantially constant) value with respect to atmospheric pressure. In these embodiments, a pressure regulator is in fluid communication with the anode chamber.

21 Claims, 5 Drawing Sheets

(51) Int. Cl.

| | |
|---|---|
| ***C25D 21/06*** | (2006.01) |
| ***C25D 21/14*** | (2006.01) |
| ***C25D 21/18*** | (2006.01) |
| ***C25D 5/00*** | (2006.01) |
| ***C25D 17/00*** | (2006.01) |
| *C25D 7/12* | (2006.01) |

(56) References Cited

U.S. PATENT DOCUMENTS

| | | | | |
|---|---|---|---|---|
| 4,105,532 | A | 8/1978 | Haines et al. | |
| 4,111,772 | A | 9/1978 | Horn | |
| 4,330,377 | A | 5/1982 | Franks, Jr. | |
| 4,459,185 | A | 7/1984 | Obata et al. | |
| 4,565,609 | A | 1/1986 | Nobel et al. | |
| 4,767,526 | A | 8/1988 | Vantard | |
| 4,828,657 | A | 5/1989 | Fukuoka et al. | |
| 4,944,851 | A | 7/1990 | Cordani et al. | |
| 5,039,576 | A | 8/1991 | Wilson | |
| 5,194,141 | A | 3/1993 | Suganuma et al. | |
| 5,200,064 | A | 4/1993 | Russ et al. | |
| 5,312,539 | A | 5/1994 | Thomson | |
| 5,403,460 | A | 4/1995 | Sala et al. | |
| 5,409,582 | A | 4/1995 | Wimbish et al. | |
| 5,456,756 | A | 10/1995 | Ramaswami et al. | |
| 5,518,957 | A | 5/1996 | Kim | |
| 5,785,833 | A | 7/1998 | Vaughan | |
| 5,883,762 | A | 3/1999 | Calhoun et al. | |
| 6,063,172 | A | 5/2000 | Bokisa et al. | |
| 6,120,673 | A | 9/2000 | Reiter et al. | |
| 6,126,798 | A | 10/2000 | Reid et al. | |
| 6,156,167 | A | 12/2000 | Patton et al. | |
| 6,251,255 | B1 | 6/2001 | Copping et al. | |
| 6,254,742 | B1 | 7/2001 | Hanson et al. | |
| 6,333,275 | B1 | 12/2001 | Mayer et al. | |
| 6,368,475 | B1 | 4/2002 | Hanson et al. | |
| 6,454,927 | B1 | 9/2002 | Stevens et al. | |
| 6,458,262 | B1 | 10/2002 | Reid | |
| 6,527,920 | B1 | 3/2003 | Mayer et al. | |
| 6,551,487 | B1 | 4/2003 | Reid et al. | |
| 6,569,299 | B1 | 5/2003 | Reid et al. | |
| 6,726,824 | B1 | 4/2004 | Khosla | |
| 6,800,187 | B1 | 10/2004 | Reid et al. | |
| 6,821,407 | B1 | 11/2004 | Reid et al. | |
| 6,878,245 | B2 | 4/2005 | Gandikota et al. | |
| 6,890,416 | B1 | 5/2005 | Mayer et al. | |
| 6,989,084 | B2 | 1/2006 | Tench et al. | |
| 7,178,410 | B2 | 2/2007 | Fraden et al. | |
| 7,195,702 | B2 | 3/2007 | Bokisa, Sr. et al. | |
| 7,273,540 | B2 | 9/2007 | Sonoda et al. | |
| 7,622,024 | B1 | 11/2009 | Mayer et al. | |
| 8,128,791 | B1 | 3/2012 | Buckalew et al. | |
| 8,262,871 | B1 | 9/2012 | Mayer et al. | |
| 8,603,305 | B2 * | 12/2013 | Rash et al. | 204/237 |
| 2002/0027080 | A1 | 3/2002 | Yoshioka et al. | |
| 2004/0065540 | A1 | 4/2004 | Mayer et al. | |
| 2004/0245113 | A1 | 12/2004 | Bokisa, Sr. et al. | |
| 2005/0062169 | A1 | 3/2005 | Dubin et al. | |
| 2005/0121317 | A1 | 6/2005 | Klocke et al. | |
| 2006/0086616 | A1 | 4/2006 | Kurashina et al. | |
| 2006/0144700 | A1 | 7/2006 | Carson et al. | |
| 2006/0144712 | A1 | 7/2006 | Klocke | |
| 2010/0032310 | A1 | 2/2010 | Reid et al. | |
| 2010/0147679 | A1 | 6/2010 | Feng et al. | |
| 2011/0226614 | A1 | 9/2011 | Rash et al. | |
| 2012/0000786 | A1 | 1/2012 | Mayer et al. | |
| 2012/0138471 | A1 | 6/2012 | Mayer et al. | |

FOREIGN PATENT DOCUMENTS

| | | |
|---|---|---|
| JP | 11-021692 | 1/1999 |
| JP | 2000-219993 | 8/2000 |
| JP | 2004-183091 | 7/2004 |
| TW | I281516 | 5/2007 |

OTHER PUBLICATIONS

U.S. Appl. No. 11/895,911, filed Aug. 27, 2007, entitled "Real-Time Monitoring of Anolyte System Integrity for a Copper Electroplating Tool".

Mayer et al., "Electroplating Apparatus and Process for Wafer Level Packaging," U.S. Appl. No. 13/305,384, filed Nov. 28, 2011.

US Office Action, dated Aug. 28, 2009, issued in U.S. Appl. No. 11/590,413.

US Final Office Action, dated Feb. 5, 2010, issued in U.S. Appl. No. 11/590,413.

US Office Action, dated Apr. 19, 2010, issued in U.S. Appl. No. 11/590,413.

US Office Action, dated Aug. 6, 2010, issued in U.S. Appl. No. 11/590,413.

US Final Office Action, dated Feb. 2, 2011, issued in U.S. Appl. No. 11/590,413.

US Office Action, dated May 24, 2011, issued in U.S. Appl. No. 11/590,413.

US Notice of Allowance, dated Oct. 27, 2011, issued in U.S. Appl. No. 11/590,413.

US Office Action, dated Feb. 18, 2011, issued in U.S. Appl. No. 11/895,911.

US Office Action, dated Dec. 31, 2012, issued in U.S. Appl. No. 13/051,822.

US Office Action, dated May 7, 2013, issued in U.S. Appl. No. 13/051,822.

US Notice of Allowance, dated Aug. 7, 2013, issued in U.S. Appl. No. 13/051,822.

Mayer et al., "Electroplating Apparatus and Process for Wafer Level Packaging," U.S. Appl. No. 61/418,781, filed Dec. 1, 2010.

Mayer et al., "Plating Method and Apparatus With Multiple Internally Irrigated Chambers," U.S. Appl. No. 12/640,992, filed Dec. 17, 2009.

U.S. Appl. No. 09/872,340, filed May 31, 2001, entitled "Methods and apparatus for bubble removal in wafer wet processing," Patton et al., incorporated by reference in its entirety by Reid et al. (U.S. Pat. No. 6,551,487), 40 pp.

US Notice of Allowance, dated Jan. 30, 2015, issued in U.S. Appl. No. 13/359,343.

US Notice of Allowance (Supplemental Notice of Allowability), dated Mar. 25, 2015, issued in U.S. Appl. No. 13/359,343.

US Office Action, dated Oct. 8, 2014, issued in U.S. Appl. No. 13/305,384.

Chinese First Office Action dated Aug. 5, 2014 issued in CN Application No. 201110071633.8.

Chinese Second Office Action [brief translation] dated Mar. 20, 2015 issued in CN Application No. 201110071633.8.

Taiwan First Office Action and Search Report dated Jan. 13, 2015 issued in TW Application No. 100109635.

* cited by examiner

ELECTROLYTE LOOP WITH PRESSURE REGULATION FOR SEPARATED ANODE CHAMBER OF ELECTROPLATING SYSTEM

CROSS-REFERENCE TO RELATED APPLICATIONS

This application is a continuation of and claims priority to application Ser. No. 13/051,822, filed Mar. 18, 2011, titled "ELECTROLYTE LOOP WITH PRESSURE REGULATION FOR SEPARATED ANODE CHAMBER OF ELECTROPLATING SYSTEM," now U.S. Pat. No. 8,603,305, which claims the benefit of priority under 35 U.S.C. §119(e) to U.S. Provisional Patent Application No. 61/315,679, filed Mar. 19, 2010, titled "ELECTROLYTE LOOP WITH PRESSURE REGULATION FOR SEPARATED ANODE CHAMBER OF ELECTROPLATING SYSTEM," all of which are incorporated herein by reference in their entireties and for all purposes.

FIELD

The present disclosure relates to electroplating systems, and more particularly to pressure regulation in a separated anode chamber of an electroplating system.

BACKGROUND

The background description provided herein is for the purpose of generally presenting the context of the disclosure. The work of the inventors, to the extent the work is described in this background section, as well as aspects of the description that may not otherwise qualify as prior art at the time of filing, are neither expressly nor impliedly admitted as prior art against the present disclosure.

Manufacturing of semiconductor devices involves deposition of electrically conductive material on substrates such as semiconductor wafers. The conductive material may be deposited by electroplating onto a seed layer of metal such as copper located in vias or trenches.

Electroplating may also be used for through-silicon vias (TSVs), which are connections that pass completely through a semiconductor wafer. Because TSVs are typically large in size and have high aspect ratios, depositing copper can be challenging. CVD deposition of copper for TSVs typically requires complex and relatively expensive precursors. PVD deposition tends to create voids and has limited step coverage. Electroplating is a preferred method for depositing copper for TSVs. However, electroplating also presents challenges due to the large size and high aspect ratio of TSVs.

TSV technology may be used in 3 dimensional (3D) packages and 3D integrated circuits. For example only, a 3D package may include two or more integrated circuits (ICs) that are stacked vertically. The 3D package tends to occupy less space and have shorter communication distances than a corresponding 2D layout.

Wafer Level Packaging (WLP) is an electrical connection technology that, like TSV, employs large features, typically on the scale of micrometers. Examples of WLP structures include redistribution wiring, bumps, and pillars. Electroplating is poised to deliver the next generation of WLP technology.

Damascene processing may be used to form interconnections for integrated circuits (ICs). In a typical Damascene process, a pattern of trenches and vias is etched in a dielectric layer of a substrate. A thin layer of diffusion-barrier film is then deposited onto the dielectric layer. The diffusion barrier film may include a material such as tantalum (Ta), tantalum nitride (TaN), a TaN/Ta bilayer, or other suitable material. A seed layer of copper is deposited on the diffusion-barrier layer using PVD, CVD or another process. Afterwards, the trenches and vias are filled with copper using electroplating. Finally, the surface of the wafer may be planarized to remove excess copper.

The electroplating system may include an electroplating cell with a cathode and an anode that are immersed in electrolyte. One lead of a power supply is connected to the cathode, which includes the copper seed layer. The other lead of the power supply is connected to the anode.

The composition of electrolyte that is used for deposition of copper may vary, but usually includes sulfuric acid, copper sulfate (e.g. $CuSO_4$), chloride ions, and/or a mixture of organic additives. Electrolytes for deposition of other metals will have their own characteristic compositions. Organic additives, such as accelerators, suppressors and/or levelers, may be used to enhance or suppress rates of plating of copper or other metal.

An electric field generated by the applied voltage electrochemically reduces metal ions at the cathode. As a result, metal is plated on the seed layer. The chemical composition of the plating solution is selected to optimize the rates and uniformity of electroplating.

Processes occurring at the anode and cathode are not always compatible. Therefore, the anode and cathode electrolyte may have the same or different chemical compositions. The anode and cathode may be separated by a membrane into different regions. For example only, insoluble particles may be formed at the anode due to flaking of the anode or precipitation of inorganic salts. The membrane may be used to block the insoluble particles, which reduces interference with the metal deposition and contamination of the wafer. The membrane may also be used to confine organic additives to the cathode portion of the plating cell.

The membrane allows the flow of ions (current) between the anode and cathode regions of the plating cell while blocking movement of larger particles and some non-ionic molecules such as organic additives. As a result, the membrane creates different environments in the cathode and the anode regions of the plating cell.

A pump may be used to pump electrolyte to the anode chamber. Periodically, fresh electrolyte and/or deionized water may be introduced to the anolyte flow, which can introduce a transient pressure differential between the electrolyte in the anode chamber and the electrolyte in the remainder of the electroplating cell. This may cause the membrane to deflect upward, which sometimes entraps air next to the membrane. Specifically, the pressure differential can allow air bubbles to trap between the membrane and the support structure. Among other problems, the trapped air will block current from flowing through the region of the membrane occupied by the air and thereby increase the current through other regions of the membrane to introduce plating non-uniformities and significantly shorten the membrane's life. Further, the separation of cathodic and anodic regions produces an electroosmotic effect in which the protons crossing the membrane from the anode chamber to the cathodic portion of the apparatus "drag" water molecules in the same direction thereby depleting the anolyte volume and increasing the volume in the cathode chamber. This effect is known as electroosmotic drag and is undesired as it creates a pressure gradient between the two chambers that can lead to membrane damage and failure.

One approach to prevent damage would be to provide a pressure sensor in the anode chamber to monitor pressure.

The sensed pressure value may be fed back in a closed loop control system to control the pressure of the pump. This approach may unfortunately require more expensive pumps that must be precisely controlled with pressure sensors in each anode chamber, which increases cost.

SUMMARY

In various embodiments described herein, the electrolyte, and particularly anolyte, is circulated via an open loop having a pressure regulator, so that the pressure in the plating chamber is maintained at some constant (or substantially constant) value with respect to atmospheric pressure. In these embodiments, a pressure regulator is in fluid communication with the anode chamber.

One disclosed aspect pertains to apparatus for electroplating onto substrates characterized by the following features: (a) a separated anode chamber for containing electrolyte and an anode; (b) a cathode chamber for receiving substrates and contacting them with a catholyte; (c) a separation structure positioned between the anode and cathode chambers; and (d) an open loop recirculation system for providing electrolyte to and removing electrolyte from the separated anode chamber during electroplating. The open loop system will include a pressure regulating device arranged to maintain the electrolyte in the anode chamber at a substantially constant pressure. Further, the open loop recirculation system may be configured to expose the electrolyte to atmospheric pressure. Typically, the open loop recirculation system is arranged to circulate electrolyte out of the separated anode chamber, through the pressure regulating device, and back into the separated anode chamber. To this end, the recirculation system may include a pump located outside the anode chamber and configured to draw electrolyte out of the pressure regulating device and force it into the separated anode chamber.

The separation structure between the chambers typically provides a transport barrier which enables passage of ionic species across the transport barrier while maintaining different electrolyte compositions in the anode chamber and the cathode chamber. As an example, the transport barrier may be a cation transport membrane. In some embodiments, the anode chamber includes a reverse conical ceiling which may hold the separation structure.

In certain embodiments, the pressure regulating device includes a vertical column arranged to serve as a conduit through which the electrolyte flows upward before spilling over a top of the vertical column. In operation, such vertical column provides a pressure head which maintains a constant pressure in the separated anode chamber. In a specific embodiment, the electrolyte in the separated anode chamber is maintained at a pressure of about 0.5 and 1 psig during operation. In addition to the vertical column, the pressure regulating device may include (i) an outer housing for holding electrolyte that has spilled over the top of the vertical column, and (ii) an outlet port for delivering recirculating electrolyte.

In some examples, the pressure regulating device may include one or more level sensors for sensing the level of electrolyte contained between the vertical column and the outer housing. In certain specific embodiments, these sensors may be provided in conjunction with a controller configured to maintain the level of electrolyte within a defined height between the vertical column and the outer housing. For additional protection, the pressure regulating device may include an open-air vent for venting electrolyte if necessary.

In various embodiments, the pressure regulating device includes a bubble separation device, such as a filter, for removing bubbles from the electrolyte. In a specific embodiment, the pressure regulator includes a filter fitted around the outside of the above-mentioned vertical column.

Turning to other features of the apparatus, a storage reservoir may be connected to the cathode chamber to provide catholyte to the cathode chamber. The storage reservoir may be configured to receive excess electrolyte from the pressure regulating device via an electrolyte overflow outlet in the device. Additionally, the electrolyte overflow outlet may be connected to a trough, which is exposed to atmospheric pressure.

The open loop recirculation system further may include an inlet for introducing additional fluid into the electrolyte. For example, the apparatus may include a make up solution entry port for directly dosing electrolyte in the recirculation system with a make up solution. Additionally or alternatively, the apparatus may include a diluent entry port for directly dosing the electrolyte in the recirculation system with a diluent. The apparatus may include a controller for controlling delivery of the diluent and the make up solution to the recirculating anolyte.

It may be desirable for two or more separated anode chambers to shares the open loop recirculation system as described above. In such embodiments, the two or more anode chambers may share a single pressure regulating device, for example.

Another disclosed aspect concerns an apparatus characterized by the following features: (a) separate anode and cathode chambers ionically connected to one another; (b) an anolyte flow loop that circulates anolyte into, out of, and through the anode chamber; (c) a porous transport barrier separating the anode chamber from the cathode chamber; and (d) a pressure regulating device coupled to the anolyte flow loop and comprising a vertical column arranged to provide pressure head that maintains the anolyte in the anode chamber at a substantially constant pressure. In this aspect, the transport barrier enables migration of ionic species across the transport barrier while substantially preventing non-ionic organic bath additives from passing across the transport barrier.

Another feature that may present is an anolyte make up subsystem that periodically delivers anolyte to the anolyte flow loop. Further, as above, the apparatus may include a catholyte storage reservoir connected to the cathode chamber to provide catholyte to the cathode chamber. Still further, the cathode chamber may include a diffuser that causes the catholyte to flow upward in a substantially uniform manner as it contacts the substrate.

These and other features and advantages will be described in detail below with reference to the associated drawings.

DESCRIPTION

Figure 1:
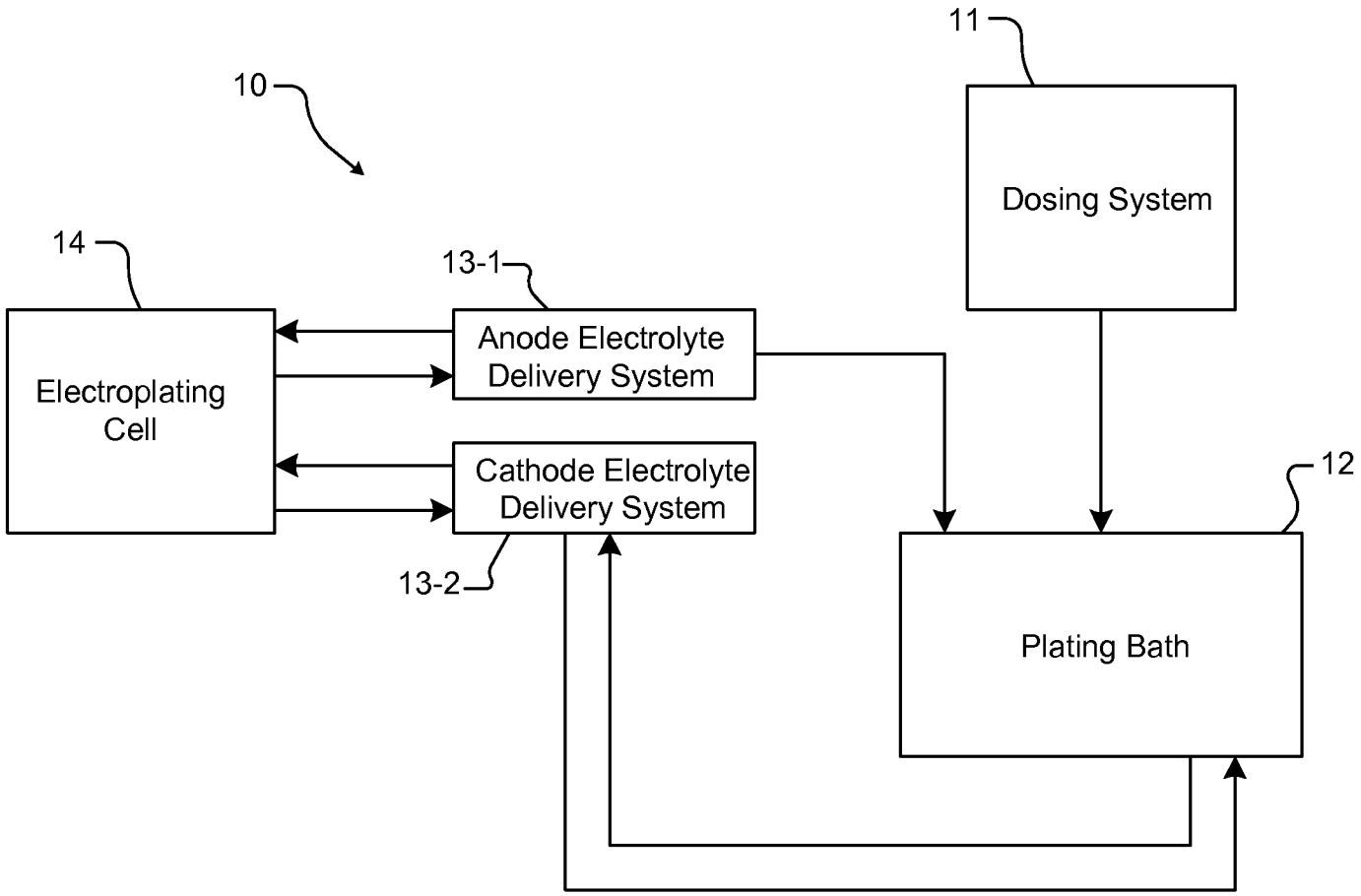
FIG. 1 is a functional block diagram showing an electroplating system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical OR. It should be understood that steps within a method may be executed in different order without altering the principles of the present disclosure.

The present disclosure relates to systems and methods for regulating pressure to a separated anode chamber in an electroplating system. Before describing the system and methods for regulating pressure further, an exemplary electroplating system (FIG. 1) and electroplating cell (FIG. 2) will be described for purposes of illustration.

Referring now to FIG. 1, an electroplating system 10 includes a dosing system 11 that alters the chemical composition of a plating bath 12. Anode and cathode electrolyte delivery systems 13-1 and 13-2 respectively deliver anode and cathode electrolyte (sometimes referred to as "anolyte" and "catholyte" respectively) to an electroplating cell 14. Plating solution may also be returned from the electroplating cell 14 to the plating bath reservoir 12 by the anode and cathode electrolyte delivery systems 13-1 and 13-2, respectively.

For example only, the anode electrolyte delivery system 13-1 may be a closed loop system that circulates anode electrolyte. Excess anode electrolyte may be returned to the plating bath as needed. The cathode electrolyte delivery system may circulate and return plating solution from the plating bath reservoir 12. As described herein, the anolyte delivery system may also be an open loop system.

Figure 2:
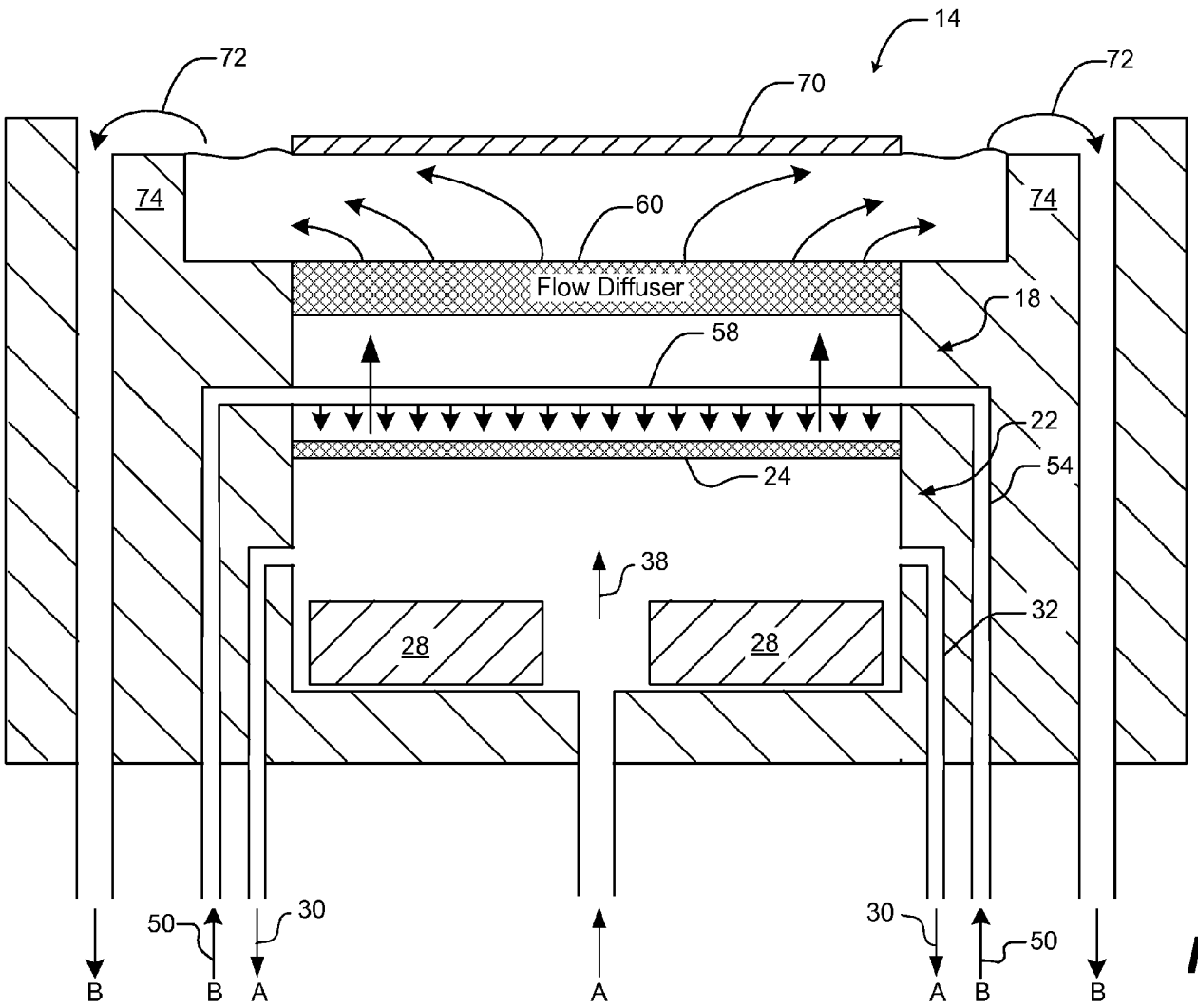
FIG. 2 is a functional block diagram of an exemplary electroplating cell.

Referring now to FIG. 2, an exemplary electroplating cell 14 is shown. While the electroplating cell 14 is shown as a separated anode chamber (SAC) electroplating cell, skilled artisans will appreciate that other types of electroplating cells can be used. The electroplating cell 14 includes a cathode chamber 18 and an anode chamber 22, which are separated by a membrane 24. While a membrane is shown, other boundary structures may be employed including sintered glass, porous polyolefins, etc. Further, the membrane may be omitted in some implementations. In various embodiments, the electrolyte in the SAC is an aqueous solution of between about 10 and 50 gm/l copper and between 0 and about 200 gm/l $H_2SO_4$.

The membrane 24 may be supported by a membrane frame (not shown). For example only, the membrane 24 may be electrically dielectric and may include micro-porous media that is resistant to direct fluid transport. For example only, the membrane 24 may be a cationic membrane. For example only, the cationic membrane may include membranes sold under the trade name Nafion®, which are available from Dupont Corporation of Wilmington Del. Electroplating apparatuses having membranes for forming separated anode chambers are described in U.S. Pat. No. 6,527,920 issued to Mayer et al., and U.S. Pat. Nos. 6,126,798 and 6,569,299 issued to Reid et al., which are all herein incorporated by reference in their entireties.

The cathode and anode chambers 18 and 22 may include cathode electrolyte and anode electrolyte flow loops, respectively. The cathode electrolyte and anode electrolyte may have the same or different chemical compositions and properties. For example only, the anode electrolyte may be substantially free of organic bath additives while the cathode electrolyte may include organic bath additives.

An anode 28 is arranged in the anode chamber 22 and may include a metal or metal alloy. For example only, the metal or metal alloy may include copper, copper/phosphorous, lead, silver/tin or other suitable metals. In certain embodiments, anode 28 is an inert anode (sometimes referred to as a "dimensionally stable" anode). The anode 28 is electrically connected to a positive terminal of a power supply (not shown). A negative terminal of the power supply may be connected to a seed layer on the substrate 70.

Flow of anode electrolyte is fed into the anode chamber 22 as shown by arrow 38 via a central port and passing through anode 28. Optionally, one or more flow distribution tubes (not shown) are used to deliver anolyte. When used, the flow distribution tubes may supply anode electrolyte in a direction towards a surface of the anode 28 to increase convection of dissolved ions from the surface of the anode 28.

The flow of anode electrolyte exits the anode chamber 22 at 30 via manifolds 32 and returns to an anode electrolyte bath (not shown) for recirculation. In some implementations, the membrane 24 may be conically-shaped to reduce collection of air bubbles at a central portion of the membrane 24. In other words, the anode chamber ceiling has a reverse conical shape. A return line for plating solution may be arranged adjacent to radially outer portions of the membrane.

While the anode 28 is shown as a solid, the anode 28 may also include a plurality of metal pieces such as spheres or another shape (not shown) arranged in a pile (not shown). When using this approach, an inlet flow manifold may be arranged at a bottom of the anode chamber 22. Flow of the electrolyte may be directed upward though a porous anode terminal plate.

The anode electrolyte may be optionally directed by one or more of the flow distribution tubes onto a surface of the anode 28 to reduce a voltage increase associated with the build up or depletion of dissolved active species. This approach also tends to reduce anode passivation.

The anode chamber 22 and the cathode chamber 18 are separated by the membrane 24. Cations travel from the anode chamber 22 through the membrane 24 and the cathode chamber 18 to the substrate 70 under the influence of the applied electric field. The membrane 24 substantially blocks diffusion or convection of non-positively charged electrolyte components from traversing the anode chamber 22. For example, the membrane 24 may block anions and uncharged organic plating additives.

The cathode electrolyte supplied to the cathode chamber 18 may have different chemistry than the anode electrolyte. For example, the cathode electrolyte may include additives such as accelerators, suppressors, levelers, and the like. For example only, the cathode electrolyte may include chloride ions, plating bath organic compounds such as thiourea, benzotrazole, mercaptopropane sulphonic acid (MPS), dimercaptopropane sulphonic acid (SPS), polyethylene oxide, polyproplyene oxide, and/or other suitable additives.

Cathode electrolyte enters the cathode chamber 18 at 50 and travels through a manifold 54 to one or more flow distribution tubes 58. While flow distribution tubes 58 are shown, the flow distribution tubes 58 may be omitted in some implementations. For example only, the flow distribution tubes 58 may include a non-conducting tubular material, such as a polymer or ceramic. For example only, the flow distribution tubes 58 may include hollow tubes with walls composed of small sintered particles. For example only, the flow distribution tubes 58 may include a solid walled tube with holes drilled therein.

One or more of the flow distribution tubes 58 may be oriented with openings arranged to direct fluid flow at the membrane 24. The flow distribution tubes 58 may also be oriented to direct fluid flow to regions in the cathode chamber 18 other at the membrane 24. A discussion of plating apparatus having fluted flow distribution tubes is contained in U.S.

patent application Ser. No. 12/640,992 filed Dec. 17, 2009 by Mayer et al. and incorporated herein by reference in its entirety.

The electrolyte eventually travels through a flow diffuser 60 and passes near a lower surface of a substrate 70. The electrolyte exits the cathode chamber 18 over a weir wall 74 as shown by arrows 72 and is returned to the plating bath.

For example only, the flow diffuser 60 may include a micro-porous diffuser, which is usually greater than about 20% porous. Alternately, the flow diffuser may include a high resistance virtual anode (HRVA) plate such as one shown in U.S. Pat. No. 7,622,024, issued Nov. 24, 2009, which is hereby incorporated by reference in its entirety. The HRVA plate is typically less than about 5% porous and imparts higher electrical resistance. In other implementations, the flow diffuser 60 may be omitted.

Various patents describe electroplating apparatus containing separated anode chambers that may be suitable for practice with the embodiments disclosed herein. These patents include, for example, U.S. Pat. Nos. 6,126,798, 6,527,920, and 6,569,299, each previously incorporated by reference, as well as U.S. Pat. No. 6,821,407 issued Nov. 23, 2004, and U.S. Pat. No. 6,890,416 issued May 10, 2005, both incorporated herein by reference in their entireties. The disclosed embodiments may also be practiced with apparatus and methods designed for simultaneously depositing two or more elements (e.g., tin and silver) such as those described in U.S. patent application Ser. No. 13/305,384, filed Nov. 28, 2011, which is incorporated herein by reference for all purposes.

In various embodiments, the electroplating apparatus used with the systems described herein has a "clamshell" design. A general description of a clamshell-type plating apparatus having aspects suitable for use with this invention is described in detail in U.S. Pat. No. 6,156,167 issued on Dec. 5, 2000 to Patton et al., and U.S. Pat. No. 6,800,187 issued on Oct. 5, 2004 to Reid et al, which are incorporated herein by reference for all purposes.

Figure 3:
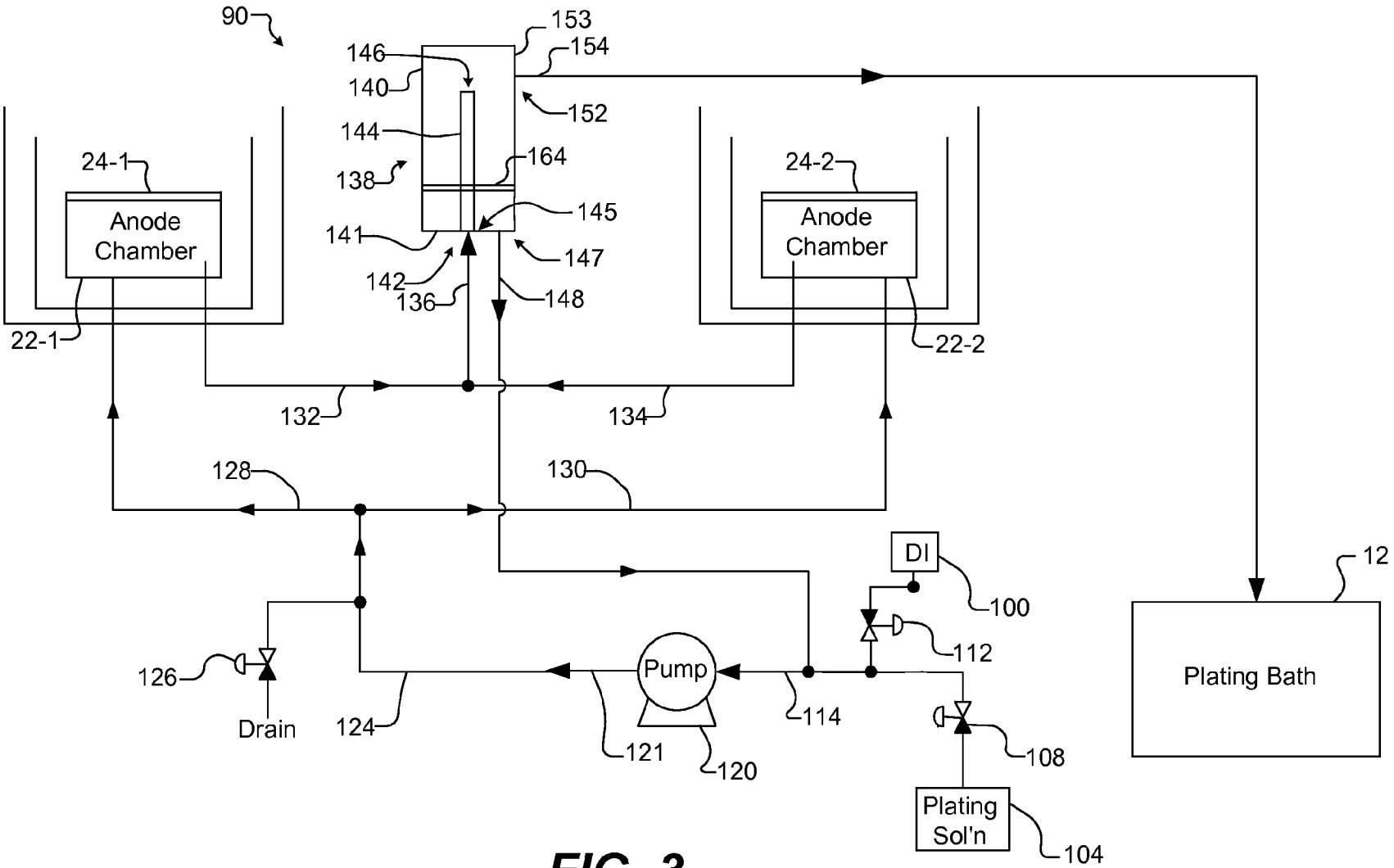
FIG. 3 is a functional block diagram of an exemplary system for regulating pressure to a separated anode chamber of an electroplating cell according to the present disclosure.

Referring now to FIG. 3, an exemplary system 90 for regulating pressure in one or more anode chambers is shown. First and second anode chambers 22-1 and 22-2 include membranes 24-1 and 24-2, respectively arranged between the anode chamber and a corresponding cathode chamber. The system 90 according to the present disclosure significantly reduces the difficulty of bubble removal as well as regulates pressure in the anode chambers 22-1 and 22-2 without requiring precision pumps and/or pressure feedback, which reduces cost and complexity.

Deionized (DI) water source 100 provides deionized water via a valve 112 to a conduit 114. A plating solution source 104 provides plating solution or electrolyte via a valve 108 to the conduit 114. The plating solution may be virgin makeup solution (VMS). For a discussion of one implementation for dosing with VMS and DI water, see, e.g., U.S. patent application Ser. No. 11/590,413, filed Oct. 30, 2006, and naming Buckalew et al. as inventors, which is incorporated herein by reference in its entirety. A pump 120 has an input in fluid communication with the conduit 114. An output of the pump 120 communicates with an input of a filter (not shown) via conduit 121. In many embodiments, this filter may be unnecessary as all the filtering is handled by a filter 164.

A conduit 124 connects to conduits 128 and 130, which are connected to the anode chambers 22-1 and 22-2, respectively. A drain valve 126 may be used to drain fluid from the conduit 124. As can be appreciated, the drain valve 126 may be positioned at other locations in the electroplating system. For example, it may be incorporated into a variant of valve 108, which variant is a three-way valve. Conduits 132 and 134 receive electrolyte from the anode chambers 22-1 and 22-2, respectively. A conduit 136 connects the conduits 132 and 134 to a pressure regulating device 138.

The pressure regulating device 138 includes a housing 140 including an inlet 142 arranged on or near a bottom surface 141 thereof. The inlet 142 communicates with a vertical tubular member 144, which includes an inlet 145 and an outlet 146. The housing 140 further includes a first outlet 147 that is spaced from the inlet 142 on or near the bottom surface 141 of the housing 140. The housing 140 further includes a second outlet 152 near an upper portion 153 of the housing 140.

In various embodiments, the pressure regulating device is exposed to atmospheric pressure. In other words, it is "open" and thereby creates an open loop for anolyte recirculation. Exposure to atmospheric pressure may be accomplished by, for example, providing vent holes or other openings in housing 140. In other cases, an electrolyte outlet pipe (e.g., conduit 154) may have an opening to allow atmospheric contact with the electrolyte. In a specific embodiment, the outlet conduit delivers electrolyte into a trough, which is of course exposed to atmospheric pressure.

In the depicted embodiment, the pressure regulating device 138 further includes filter medium 164. The filter medium 164 may include porous material that filters bubbles from the electrolyte. The filter medium 164 may be positioned in a horizontal position as shown or in any other suitable position to filter bubbles and/or particles from the anode electrolyte before the anode electrolyte returns to the anode chambers 22-1 and 22-2. More general, other forms of bubble separation devices may be employed. These include thin sheets of porous material such as "Porex"™ brand filtration products (Porex Technologies, Fairburn, Ga.), meshes, activated carbon, etc.

In some implementations, the filter medium 164 may be arranged outside of the housing 140 in line with the conduit 121 or another conduit. In other implementations, the filter medium 164 may be arranged at an angle between horizontal and vertical. In still other implementations, the filter medium 164 may be arranged in a vertical position and the outlet may be arranged on a side wall of the housing 140. Still other variations are contemplated and discussed below in the context of FIG. 5.

In a specific embodiment, filter 164 has a sleeve shape and fits over tubular member 144. It may fit from top to bottom over the sleeve or over at least a substantial fraction of the height. In some cases, the filter includes a sealing member such as an o-ring disposed at a location on the inner circumference of the filter and mating with the tubular member 144. The filter is configured to remove particles and/or gas bubbles from the electrolyte before delivering the electrolyte to outlet 147. For bubble management, it may be sufficient that the filter have pores sized at approximately 40 micrometers or smaller, or in some cases sized at approximately 10 micrometers or smaller. In a specific embodiment, the average pore size is between about 5 and 10 micrometers. Such filters have the additional benefit of removing very large particles. As an example, suitable filters may be obtained from Parker Hannifin Corp., filtration division, Haverhill, Mass. (e.g., a 5 micron pore size pleated polypropylene filter part number PMG050-9FV-PR). In some designs, the outer diameter of the filter will be between about 2 and 3 inches. Further, the filter size may be chosen so that some space remains between the filter and the outer housing of the pressure regulator. Such a gap can allow easier and more reliable tuning of level sensors in the pressure regulator (see the discussion of FIG. 5 below). In some embodiments, the regulator housing and the filter are sized so that a gap of about 0.2 to 0.5 inches remains between them.

The first outlet 147 communicates with a conduit 148, which returns anode electrolyte and completes an anode electrolyte flow loop. A conduit 154 connects the second outlet 152 to the plating bath reservoir 12 to handle overflow of anode electrolyte as needed. In some cases, as indicated above, the conduit 154 empties into a trough (not shown) prior to reaching a tank for holding plating bath 12.

In some implementations, the inlet 145 of the vertical tubular member 144 is vertically located below at least a portion of the membranes 24-1 and 24-2. The outlet 146 of the vertical tubular member 144 is located above the membranes 24-1 and 24-2.

In certain embodiments, the plating bath reservoir 12 provides catholyte to the cathode chambers. Because the electrolyte provided to the plating bath from pressure regulator 138 is anolyte, which may be without plating additives, the composition of electrolyte in the plating bath may require adjustment prior to delivering to the cathode chambers. For example, some plating additives may be dosed into the plating bath in while held in reservoir 12.

In use, the anode chambers 22-1 and 22-2 may be initially filled with plating solution and/or deionized water. The pump 120 may be turned on to provide flow. In some implementations, the pump 120 may provide approximately 2-4 liters per minute. The pump 120 causes variations in the pressure of the electrolyte in the anode chambers 22. Additionally, delivery of fresh plating solution from source 104 may introduce transient increases in the anolyte pressure within chambers 22. As the pressure in the anode chamber 22 increases, electrolyte flows out of the vertical tubular member 144 and down an outer surface of the vertical tubular member 144. The electrolyte flows through the filter medium 164 (if present) and out the outlet 147.

The pressure regulating device 138 regulates pressure in the anode chamber 22 and tends to prevent damage to the membrane 24. The system can be run using an open loop approach and without high cost pressure sensors and pumps.

In certain embodiments, system 90 is designed and operated such that the anolyte pressure within an anode chamber is maintained between about 0 and 1 psig. In more specific embodiments, the anolyte pressure is maintained at a pressure of between about 0.5 and 1.0 psig (e.g., about 0.8 psig). Typically, the pressure in the anode chamber is a sum of the pressure head in the pressure regulating device 138 and the pressure introduced by pump 120. In certain designs, the pressure head in device 138 is about 0.1 to 0.5 psig (e.g., about 0.3 psig).

Figure 4:
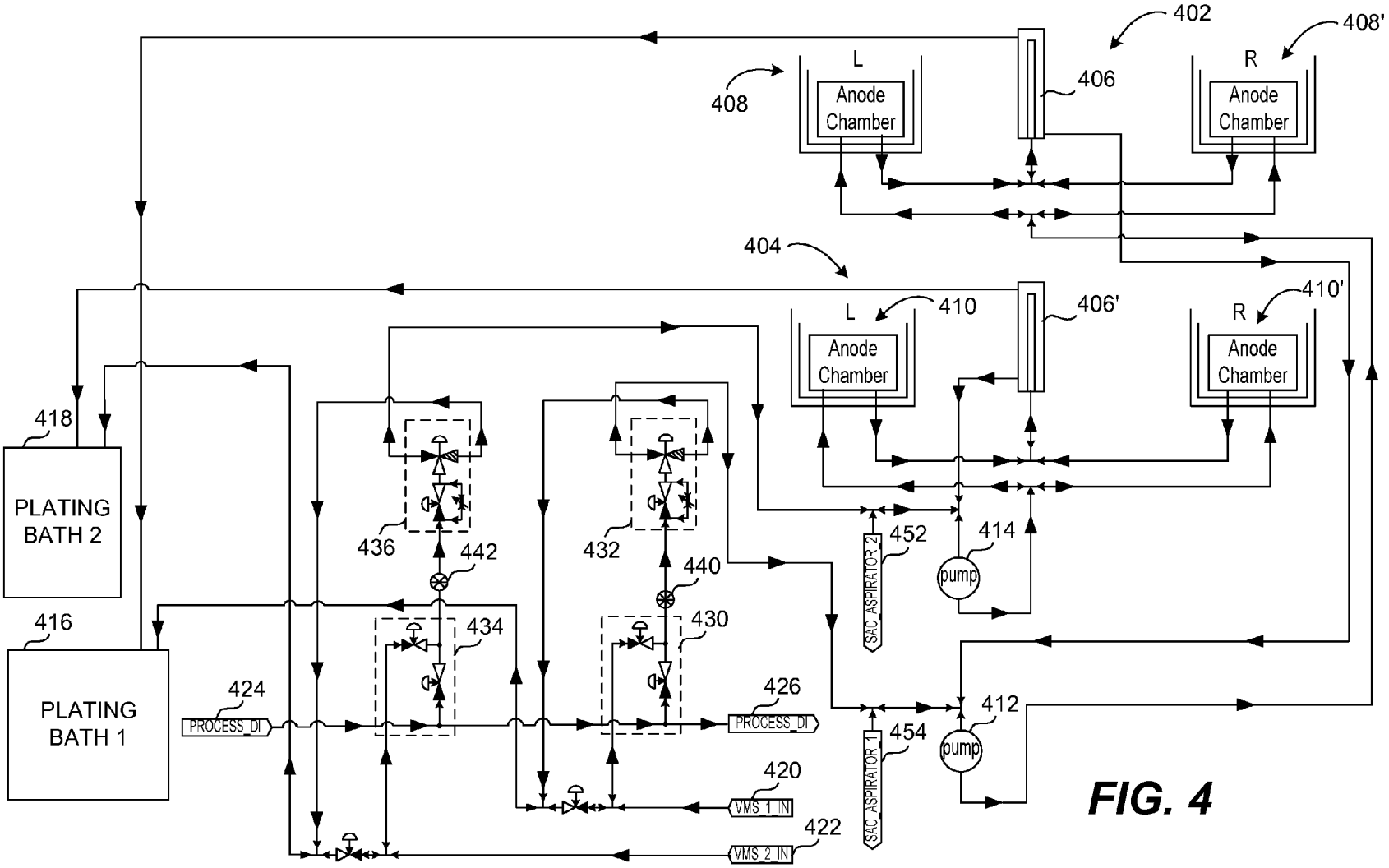
FIG. 4 is a functional block diagram of another example system for regulating pressure to a separated anode chamber of an electroplating cell according to the present disclosure.

FIG. 4 provides another embodiment employing four separate plating cells (408, 408', 410, and 410') arranged in two group (402 and 404), each with its own pressure regulating device (406 and 406'), which operate as described herein. The anolyte recirculation loops for groups 402 and 404 are driven by pumps 412 and 414, respectively. Overflow from pressure regulators 406 and 406' is provided to plating bath reservoirs 416 and 418, respectively. In the disclosed embodiment, make up solution is provided via sources 420 and 422 and may be provided to either the anolyte recirculation loops or the plating bath reservoirs under the control of valve groups 430, 432, 434, and 436 as shown. Similarly, DI water provided via source 424 and removed at point 426 is controlled by the same valve groups. Note that the water flowing between points 424 and 426 would normally be provided as part of a separate DI water subsystem (not shown) at the facility where the plating chambers are installed. Flow meters 440 and 442 allow for precise metering of the make up solution and/or DI water to anolyte recirculation loops and/or plating bath reservoirs. A controller (not shown) controls the operation of the valves to permit appropriate dosing of the electrolyte with make up solution and DI water. The controller receives feedback from flow meters 440 and 442. The controller may also control dosing of plating additives to the plating baths.

Additional flow control and monitoring can be provided at various locations to provide flow balancing to each of the anode chamber pairs. For example, flow meters and/or pressure switches can be provided as shown at various locations. For example, flow meters may be placed directly downstream from pumps 412 and 414. Still other locations will be apparent to skilled artisans. Additionally, manual valves may be provided at various locations to adjust flow.

Figure 5:
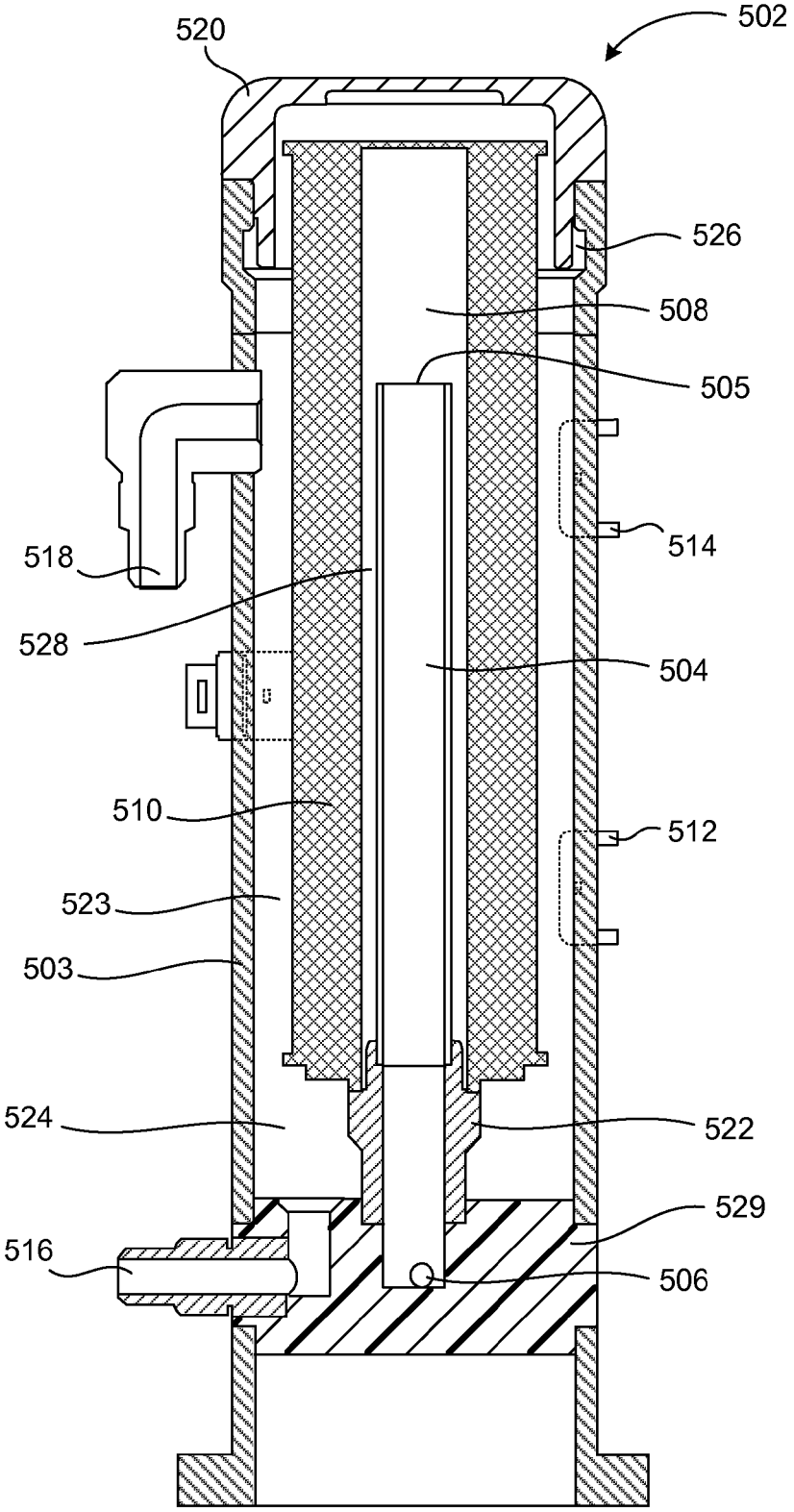
FIG. 5 is an illustration of a pressure regulating device in accordance with certain embodiments.

FIG. 5 is a cross-sectional depiction of a pressure regulation device suitable for some implementations of the open loop systems described herein. In FIG. 5, the pressure regulator is depicted as item 502 having a housing 503 and a cap 520, which together define an outer structure of the regulator. The cap and housing may be attached by various mechanisms such threads, bonding, etc.

In operation, anolyte from a separated anode chamber such as chamber 22-1 or chamber 22-2 shown in FIG. 3 is pushed into device 502 via one or more inlets 506 at the base of a center column 504. In various embodiments, there is a separate entry port (like port 506) for each of the various anode chambers serviced by pressure regulator 502. In FIG. 5, only one such entry port is depicted. In the depicted embodiment, column 504 is mounted to the regulator 502 via a stem 522 embedded in a solid structural piece in the interior of housing 503.

The electrolyte pushed into center column 504 flows upward to a top 505 of column 504, where it spills over into an annular gap 528 and comes into contact with a filter 510. In various embodiments, gap 528 is relatively small to facilitate efficient filtering. As an example, gap 528 may be about 0.1 to 0.3 inches wide. Note that filter 510 is sealed to column 504 at, for example, the base of filter 510. An o-ring may be employed for this purpose. Note also that the depicted design includes an interstitial space 508 directly above the top 505 of column 504. This provides room for accommodating transient electrolyte surges out of column 504.

The pressure head of electrolyte in column 504 is responsible for maintaining a constant pressure within the separated anode chambers of the plating cells serviced by pressure regulator 502. Effectively, it is the height of central column 504 (at least the height above the electrolyte in the plating cell(s)) that dictates the pressure experienced by the electrolyte in the separated anode chambers. Of course, the pressure within these anode chambers is also influenced by the pump which drives recirculation of electrolyte from pressure regulator 502 and into the separated anode chambers.

The electrolyte flowing out of the top of column 504 encounters filter 510, as mentioned. The filter is preferably configured to remove any bubbles or particles of a certain size from the electrolyte flowing up through and out of column 504. The filter may include various pleats or other structures designed to provide a high surface area for greater contact with the electrolyte and more effective filtering. The pleats or other high surface area structure may occupy a void region within housing 503. Electrolyte passing through filter 510 will enter into a void region 523 between housing 503 and the outside of filter 510. The fluid in this region will flow down into an accumulator 524, where it may reside temporarily as it is drawn out of regulator 502.

Specifically, in the depicted embodiment, the electrolyte passing through filter 510 is drawn out of pressure regulator 502 through an exit port 516. As illustrated in various embodiments described earlier, an exit port such as port 516 is connected to a pump which draws out the electrolyte and forces recirculation through the separated anode chamber(s).

It may be desirable for filtered electrolyte temporarily accumulating within pressure regulating device 502 to maintain a certain height in region 523. To this end, the depicted device includes level sensors 512 and 514. In certain embodiments, the system is operated under the influence of a controller such that the liquid in region 523 remains at a level between sensors 512 and 514. If the electrolyte drops below level 512, the system is in danger of having the pump run dry, a condition which could cause serious damage to the pump. Therefore, if a controller senses that the electrolyte is dropping below level 512, appropriate steps may be taken to counteract this dangerous condition. For example, the controller may direct that additional make up solution or DI water be provided into the anolyte recirculation loop.

If, on the other hand, the electrolyte rises to a level above that sensed by sensor 514, the controller may take steps to reduce the amount of recirculating anolyte by, optionally, draining a certain amount of electrolyte from the recirculation loop. This could be accomplished by, for example, directing an associated aspirators 452 or 454 (FIG. 4) to remove electrolyte from the open flow loop. Note that pressure regulator 502 is outfitted with a separate overflow outlet 518 which will allow excess electrolyte to drain out of the pressure regulator and into a reservoir holding the plating bath. As mentioned, such reservoir may provide electrolyte directly to a cathode chamber of the plating cells. Also, as mentioned, a conduit connected to exit port 518 may provide an opening to atmospheric pressure such as via connection to a trough which receives the electrolyte before flowing into a plating bath reservoir. Alternatively, or in addition, the pressure regulator may include a vent mechanism. In the depicted embodiment, an optional vent hole 526 is included under a finger of cap 520. The finger is designed to prevent spraying electrolyte from directly passing out of regulator 502.

The dimensions and construction of the pressure regulating device may be chosen to meet the constraints of the plating cell(s) it services, the hydrodynamic conditions created in recirculation loop, etc. In certain embodiments, the top of the central tubular member into which the anolyte flows when it enters the pressure regulator is between about 5 and 20 centimeters above the top surface electrolyte in the cell it serves (e.g., above the top surface of the weir wall 74 shown in FIG. 2). In a specific embodiment, this height difference is about 8 inches.

As noted, an open loop design such as that described herein maintains a substantially constant pressure in the anode chamber. Thus, in some embodiments, it is unnecessary to monitor the pressure of the anode chamber with a pressure transducer or other mechanism. Of course, there may be other reasons to monitor pressure in the system, for example to confirm that the pump is continuing to circulate electrolyte.

The apparatus and processes described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light through a mask using a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper. This process may provide a pattern of features such as damascene, TSV, or WLP features that may be electrofilled with copper or other metal using the above-described apparatus.

As indicated above, various embodiments include a system controller having instructions for controlling process operations in accordance with the present invention. For example, a pump control may be directed by an algorithm making use of signals from the level sensor(s) in the pressure regulating device. For example, if a signal from a lower level sensor shown in FIG. 5 indicates that fluid is not present at the associated level, the controller may direct that additional make up solution or DI water be provided into the anolyte recirculation loop to ensure that there is sufficient fluid in the line that the pump will not operate dry (a condition which could damage the pump). Similarly, if the upper level sensor signals that fluid is present in the associated level, the controller may direct may take steps to reduce the amount of recirculating anolyte, as explained above, thereby ensuring that the filtered fluid in the pressure regulating device remains between the upper and lower levels of the sensors. Optionally, a controller may determine whether anolyte is flowing in the open recirculation loop using, for example, a pressure transducer or a flow meter in the line. The same or a different controller will control delivery of current to the substrate during electroplating. The same or a different controller will control dosing of make up solution and/or deionized water and/or additives to the plating bath and anolyte.

The system controller will typically include one or more memory devices and one or more processors configured to execute the instructions so that the apparatus will perform a method in accordance with the present invention. Machine-readable media containing instructions for controlling process operations in accordance with the present invention may be coupled to the system controller.

As can be appreciated, any of the valves shown in the figures may include manual valves, air controlled valves, needle valves, electronically controlled valves, bleed valves and/or any other suitable type of valve.

The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A method of electroplating material onto a substrate surface, comprising:

(a) immersing the substrate surface in catholyte in a reaction vessel comprising:

(i) a separated anode chamber for containing anolyte and an anode;

(ii) a cathode chamber for receiving substrates and contacting them with catholyte; and (iii) a separation structure positioned between the separated anode chamber and the cathode chamber, said separation structure comprising a transport barrier which enables passage of ionic species across the transport barrier while maintaining different electrolyte compositions in the anode chamber and the cathode chamber;

(b) circulating anolyte through an open loop recirculation system coupled to the separated anode chamber, wherein the circulating comprises flowing the anolyte through a pressure regulating device that exposes the anolyte to atmospheric pressure and thereby maintains the anolyte in the separated anode chamber at a substantially constant pressure, wherein the pressure regulating device is in the recirculation system coupled to the separated anode chamber; and (c) electroplating material onto the substrate surface.

2. The method of claim 1, wherein the pressure regulating device compensates for depletion of anolyte in the separated anode chamber that arises due to an electroosmotic effect.

3. The method of claim 1, further comprising providing a constant pressure head to maintain the anolyte at a substantially constant pressure.

4. The method of claim 3, wherein the constant pressure head is between about 0.1-0.5 psig.

5. The method of claim 1, wherein flowing the anolyte through the pressure regulating device comprises flowing anolyte upwards through a vertical column of the pressure regulating device and allowing the anolyte to spill over a top of the vertical column.

6. The method of claim 5, wherein the pressure regulating device comprises an accumulator into which anolyte flows after spilling over the top of the vertical column, and further comprising flowing anolyte from the accumulator to the separated anode chamber.

7. The method of claim 6, further comprising flowing anolyte from the accumulator to the cathode chamber or to a storage reservoir for holding catholyte delivered to the cathode chamber.

8. The method of claim 6, further comprising flowing anolyte through a filter medium fitted around the vertical column to remove bubbles before the anolyte flows into the accumulator.

9. The method of claim 6, wherein a pump draws anolyte from the accumulator and forces it into the separated anode chamber.

10. The method of claim 1, further comprising flowing catholyte from the cathode chamber to a storage reservoir and back to the cathode chamber.

11. The method of claim 1, further comprising directing a flow of anolyte through flow distribution tubes onto a surface of the anode.

12. The method of claim 1, wherein the anode is a porous anode terminal plate, and further comprising directing a flow of anolyte upwards through the porous anode terminal plate.

13. The method of claim 1, further comprising flowing catholyte through a porous flow diffuser plate.

14. The method of claim 13, wherein the flow diffuser plate is at least about 20% porous.

15. The method of claim 13, wherein the flow diffuser plate is about 5% porous or less.

16. The method of claim 1, further comprising flowing the anolyte through a second separated anode chamber of a second reaction vessel.

17. The method of claim 1, further comprising sensing that a height of anolyte in the pressure regulating device is outside a desired range, and adding or removing anolyte or diluent from the open loop recirculation system to bring the height of anolyte in the pressure regulating device inside the desired range.

18. A method of electroplating material onto a substrate surface, comprising:

(a) immersing the substrate surface in catholyte in a reaction vessel comprising:

(i) a separated anode chamber for containing anolyte and an anode;

(ii) a cathode chamber for receiving substrates and contacting them with catholyte; and (iii) a separation structure positioned between the separated anode chamber and the cathode chamber, said separation structure comprising a transport barrier which enables passage of ionic species across the transport barrier while maintaining different electrolyte compositions in the anode chamber and the cathode chamber;

(b) circulating anolyte through a recirculation system coupled to the separated anode chamber, wherein circulating comprises flowing anolyte upward through a vertical column of a pressure regulating device that exposes the anolyte to a constant pressure at the top of the pressure regulating device and thereby maintains the anolyte in the separated anode chamber at a substantially constant anolyte pressure; and (c) electroplating material onto the substrate surface.

19. The method of claim 18, further comprising flowing the anolyte through a second separated anode chamber of a second reaction vessel, wherein the pressure regulating device operates to maintain the substantially constant anolyte pressure in both the reaction vessel and the second reaction vessel.

20. An apparatus for electroplating onto substrates, comprising:

(a) a separated anode chamber for containing anolyte and an anode;

(b) a cathode chamber for receiving substrates and contacting them with a catholyte;

(c) a separation structure positioned therebetween, said separation structure comprising a transport barrier which enables passage of ionic species across the transport barrier while maintaining different electrolyte compositions in the anode chamber and the cathode chamber; and (d) a recirculation system for providing anolyte to and removing anolyte from the separated anode chamber during electroplating, wherein the recirculation system comprises a pressure regulating device comprising a vertical column through which anolyte flows upward before spilling over a top of the vertical column, and wherein the top of the vertical column is exposed to a substantially constant pressure such that the anolyte in the separated anode chamber is maintained at a substantially constant anolyte pressure, wherein the pressure regulating device is separate from the separated anode chamber.

21. The apparatus of claim 20, further comprising a second separated anode chamber that shares the open loop recirculation system with the separated anode chamber recited in claim 1.

* * * * *